United States Patent [19]

Corsette

[11] Patent Number: 4,494,680

[45] Date of Patent: Jan. 22, 1985

[54] MANUALLY OPERATED DISPENSING PUMP

[76] Inventor: Douglas F. Corsette, 6559 Firebrand St., Los Angeles, Calif. 90045

[21] Appl. No.: 502,274

[22] Filed: Jun. 8, 1983

Related U.S. Application Data

[63] Continuation-in-part of Ser. No. 121,223, Feb. 13, 1980, Pat. No. 4,402,432.

[51] Int. Cl.[3] ..... B05B 11/00

[52] U.S. Cl. ..... 222/321; 222/380; 222/383

[58] Field of Search ..... 222/321, 380, 383, 381, 222/385, 372; 239/333, 331

[56] References Cited

U.S. PATENT DOCUMENTS 4,050,613 9/1977 Corsette ..... 222/321

4,183,449 1/1980 Blake ..... 222/321

*Primary Examiner*—F. J. Bartuska

*Assistant Examiner*—Andrew Jones

*Attorney, Agent, or Firm*—Watson, Cole, Grindle & Watson

[57] ABSTRACT

A dispensing pump of the pressure accumulating type includes a reciprocable plunger/accumulator which is free floating between spring force below and hydraulic force above and is unrestrained against movement in response to these forces, and/or which has at its upper end by an air displacement interfacing contour which avoids after spray as discharge valve closing is mechanically assisted at the end of the discharge stroke.

15 Claims, 6 Drawing Figures

MANUALLY OPERATED DISPENSING PUMP

RELATED APPLICATION

This application is a continuation-in-part of U.S. application Ser. No. 121,223, filed Feb. 13, 1980 now U.S. Pat. No. 4,402,432.

BACKGROUND OF THE INVENTION

This invention relates generally to a dispenser of the pressure accumulating type, and is an improvement over my earlier U.S. Pat. No. 4,050,613. More particularly, the present pump includes a modified plunger/accumulator designed to avoid unwanted dribbles or drips after the discharge passage is thereby closed.

Dispensers and sprayers of the pressure accumulating type, disclosed in the aforementioned patent application and patent, have a plunger member which reciprocates on a hollow stationary piston in response to the force of return spring from below and hydraulic force from above. The plunger functions as a discharge valve which closes in response to spring pressure as it returns to its seated position against the underside of the plunger head, the discharge passage being formed in the plunger head and extending to the atmosphere from an accumulation chamber defined by a downwardly directed blind socket formed at the underside of the plunger head for snugly slidably receiving the plunger. Thus, upon depression of the plunger head, pressure within the primed pump chamber increases within the accumulation chamber to a degree sufficient to overcome the opposing force of the spring whereupon the plunger moves relative to the plunger head to thereby open the discharge. Dispensing of product will continue under pressure through the open discharge passage so long as the hydraulic pressure in the accumulation chamber continues to overcome the opposing force of the return spring. When the spring force takes over, i.e., upon insufficient finger pressure exerted on the plunger head or upon discharge of the pump chamber and accumulation chamber contents near the end of the plunger downstroke, the plunger automatically reseats within the plunger head socket to thereby close the discharge passage. As the pump chamber expands during the ensuing plunger upstroke, a new charge of product is drawn into the pump chamber through the valve controlled inlet contained within the hollow stationary piston.

Although the aforedescribed dispensing pump operates quite efficiently and effectively in discharging product after the discharge is closed, an optional approach is available for avoiding any unexpected discharge at the commencement of the recharge stroke of the plunger.

If the plunger head of the example the pump according to the aforementioned application or my earlier patent U.S. Pat. No. 4,050,613, is subjected to lateral or eccentric forces during the dispensing operation, as when the operator reciprocates the head non-axially, such forces tend to induce a frictional load between the plunger and discharge valve elements which can permit the plunger-discharge valve to be momentarily held open at the end of the plunger downstroke with a small quantity of product remaining within the discharge passage. When the actuating force on the head is relieved, even slightly, the frictional holding force or brake on the plunger is relaxed. This then causes the return spring to shift the plunger immediately to its discharge valve closing position. Thus, the small amount of product which had been left in the discharge passage at the end of the discharge stroke is now suddenly purged at the start of the plunger intake stroke as the plunger closes under the force of the spring. Thus, if the plunger member is partially or wholly unrestrained by frictional engagement due to opposing force couples or lateral pressure acting on the head, then it will respond continuously and promptly in the intended operating mode in balance between the hydraulic pressure and the opposing spring force.

Also, the dispensing pump of the aforementioned application carries a contoured surface interfacing the stationary piston as an integral part of the plunger head. Thus, when the upper end of the piston and the opposing matching inner end of the plunger head are brought in face-to-face contact during a depression of the head, before the dispensing operation, any air accumulated in the pump chamber is substantially purged by venting it through the discharge as that air is compressed to effect a shifting of the plunger relative to the head for opening the discharge. This contoured surface displaces air volume in the pump chamber and extends into the open upper end of the plunger so that such surface bottoms against the upper end of the stationary piston and ball check members at the end of the plunger head downstroke. Thus, it is possible to exercise the discharge stroke at a velocity producing a pumping rate in excess of the orifice discharge capacity at the controlled design pressure. In accordance with this dispensing pump arrangement, the plunger head reaches the bottom of its stroke while the plunger is still in the valve open mode, displaced from the seat in the head, and continuing the discharge at rated pressure, expelling the accumulated product as the spring force returns the plunger to its seated, valve closed position against the interior of the head. This may be called "after-spray" which could result in unwanted dribbles and drips from the discharge, similar to the inertial "after-spray" of throttling and non-pressure build-up pumps, but which is minimized by the aforedescribed pump arrangements and by the present pump development.

SUMMARY OF THE INVENTION

It is therefore an object of the present invention to provide an optional arrangement for a manually operated dispensing pump of the pressure accumulating type in which the plunger or accumulator is made to promptly and precisely close the discharge at the end of the plunger head downstroke and before the start of the ensuing upstroke.

Another object of this invention is to provide such a pump wherein the plunger is isolated from lateral or eccentric forces which may be applied to the plunger head, so that the plunger which functions as a discharge valve is free from restraint by frictional engagement due to opposing force couples or lateral pressure and will therefore respond continuously and promptly in the intended operating mode in balance between the hydraulic pressure and opposing spring force.

A further object of this invention is to provide such a dispensing pump as having spaced bearing members for guiding the plunger head to effect isolation of the plunger during pump operation.

A still further object of the present invention is to provide such a dispensing pump wherein skirt means on or engaging the plunger head carry such bearing members to effect an unrestrained reciprocation of the plunger.

A still further object of this invention is to provide such a dispensing pump wherein the skirt means comprise concentric skirts which extend from the plunger head and carry the bearing members.

A still further object of the present invention is to provide such a dispensing pump wherein one of the bearing members is carried by an upstanding collar or skirt on the pump body which engages the head.

A still further object of this invention is to provide such a pump wherein the skirt means comprises a plunger skirt which itself carries the bearing members, or wherein one of such bearing members is carried by an upstanding collar or skirt on the pump body which engages such skirt.

A still further object of this invention is to provide such a dispensing pump wherein the upper end of the plunger has a wall defining a surface facing the upper end of the piston and complementarily contoured to at least the lip seal portion thereof, the wall having at least one part therein for maintaining communication between the pump and accumulation chambers, and the wall permitting the plunger to bottom out against the upper end of the piston before the end of the plunger head downstroke thereby allowing for further depression of the head so that it will continue to expel product through the discharge passage upon further depression thereof as the plunger moves into its discharge closing position.

Other objects, advantages and novel features of the invention will become more apparent from the following detailed description of the invention when taken in conjunction with the accompanying drawings.

DETAILED DESCRIPTION OF THE INVENTION

Figure 1:
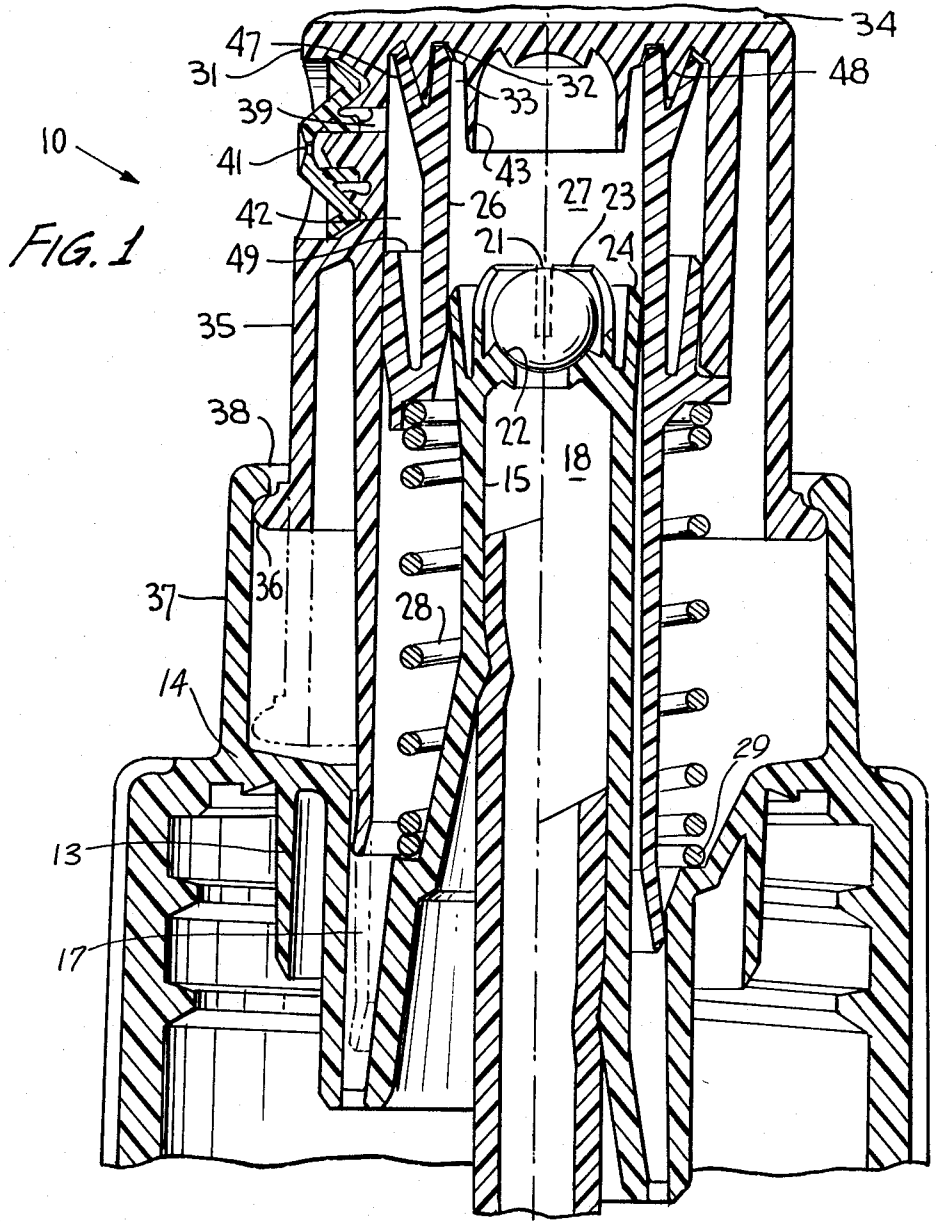
FIG. 1 is a vertical sectional view of one embodiment of a dispensing pump according to the invention.

Turning now to the drawings wherein like reference characters refer to like and corresponding parts throughout the several views, FIG. 1 illustrates a pump assembly, generally designated 10, of the pressure accumulating type which is structured and functions similar to that of the aforementioned patent application and to that shown in my prior U.S. Pat. No. 4,050,613. The entirety of this patent is therefore specifically incorporated herein by reference. The pump assembly comprises a pump body 11 which includes an integrally formed closure cap 12 which may be internally threaded for securing the pump body in a liquid tight manner over the similarly threaded neck of a container (not shown), which is adapted to hold a flowable product to be dispensed by the pump. Otherwise, the closure cap may be adapted for snapping it in place over the opening of the container, or the cap may be separate from the pump body for snapping or threading it in place. An annular sleeve 13 depends from an upper wall 14 of the pump body and extends into the container neck for enhancing the fluid tight seal between the pump body and the container.

A stationary, hollow upstanding piston 15 is integrally formed on upper wall 14 via an annular wall which surrounds the base of the piston in spaced relationship and defines together therewith a container vent chamber 17. The piston has an inlet passage 18 extending therethrough into which a conventional dip tube 19 is coupled in any normal manner, the dip tube having its lower end extending into the product to be dispensed from the container. A ball check valve 21 and ball seat 22 are provided at the upper end of the piston for valve controlling the inlet passage, and a plurality of ball retention fingers 23 surround the ball check valve in spaced relation to permit unseating thereof during the suction stroke. And, the upper end of the piston terminates in an annular lip seal 24 which flares slightly outwardly in the normal manner.

At least one container vent opening 25 is located in a lower portion of the vent passage and facilitates equalization of pressures within and outside the container as in the conventional manner so as to replace the product dispensed from the container with air to avoid collapse of the container and a vacuum lock condition within the pump.

An annular plunger or accumulator 26 surrounds the pump piston, snugly embraces the same at its lip seal 24 and reciprocates relative thereto so as to therewith define a variable volume pump chamber 27. A return spring 28 extending between the underside of the plunger and a shoulder 29 formed on the pump body resiliently urges the plunger upwardly toward a fully raised position above the pump body.

A plunger head 31 has a downwardly directed blind socket 32 which snugly and slidably receives plunger 26 and defines therewith an enclosed variable volume accumulation chamber 33 in open communication with pump chamber 27. This accumulation chamber has an appropriately larger diameter than the pump chamber, and the annular upwardly presented end of the plunger is exposed to downward fluid pressure within the accumulation chamber in opposition to the upward thrust of return spring 28.

The plunger head is conformed to present an upwardly directed finger piece 34 so that intermittent finger pressure conveniently applied to it may be transmitted to the plunger for producing reciprocation thereof on stationary piston 15, each depression of the plunger being yieldably resisted by spring 28 which returns the plunger to its fully raised position each time finger pressure on the head is relieved.

The plunger has an outer, annular depending skirt 35 terminating in an outwardly extending retention bead 36 which is outwardly dimensioned to be guided as it slides along the inner surface of an upstanding collar or skirt 37 on the pump body. The upper end of collar 37 has an inwardly extending retention bead 38 which cooperates with bead 36 for limiting upward movement of the plunger head at the predetermined position. However, these retention beads, or stop shoulders, need not sealingly interengage since leakage of product through the container vent opening in the raised position of the plunger and plunger head shown in FIG. 1, is otherwise positively prevented.

The plunger head includes a discharge passage 39 which terminates in a discharge orifice 41 and which extends from a discharge chamber 42 defined by the space between the plunger and plunger head. Thus, dispensed product is conveyed through this discharge path from the accumulation chamber into the atmosphere during pumping operation, as the discharge path opens into the blind socket below the blind upper end of the plunger at a location such that this upper end is normally covered by the plunger when the latter is projected into its fully raised position as in FIG. 1 into the blind end of socket 32 by spring 28.

The upper end of the plunger head carries a contoured surface 43 as an integral part of the head and projects into pump chamber 27 partially displacing the air volume therein. This contoured surface is shaped to match the contour at the upper end of the piston, including the ball check valve and ball retention fingers as well as lip seal 24. Thus, the upper end of the piston and the opposing inner end of the plunger head are complementarily contoured so that when brought into face-to-face contact during a depression of the head, before the dispensing operation, any air which accumulated in pump chamber 27 is substantially purged by venting it through the discharge as that air is compressed and acts on the larger diameter accumulation chamber so as to shift the plunger relative to the discharge for the opening of same.

The opening and closing of vent chamber 17 during plunger reciprocation is carried out in substantially the same manner as that disclosed for the pumps shown in my parent application Ser. No. 121,223. However, an annular vent skirt 44, which controls the opening and closing of the vent, depends from the plunger head, rather than from the plunger, and terminates in an annular vent seal 45 which sealingly engages the inner surface of wall 16, as shown in the upwardly extended, vent closed position of FIG. 1. This inner surface 46 may have a slightly outwardly conical taper as it extends from the upper to the lower ends of the vent chamber so that a gradually increasing annular gap is formed between vent seal 45 and surface 46 as the plunger extends to its phantom outline position upon depression of the head. In this position, the container interior communicates with the atmosphere through vent opening 25 and open vent passage 17 outwardly of the pump.

Figure 5:
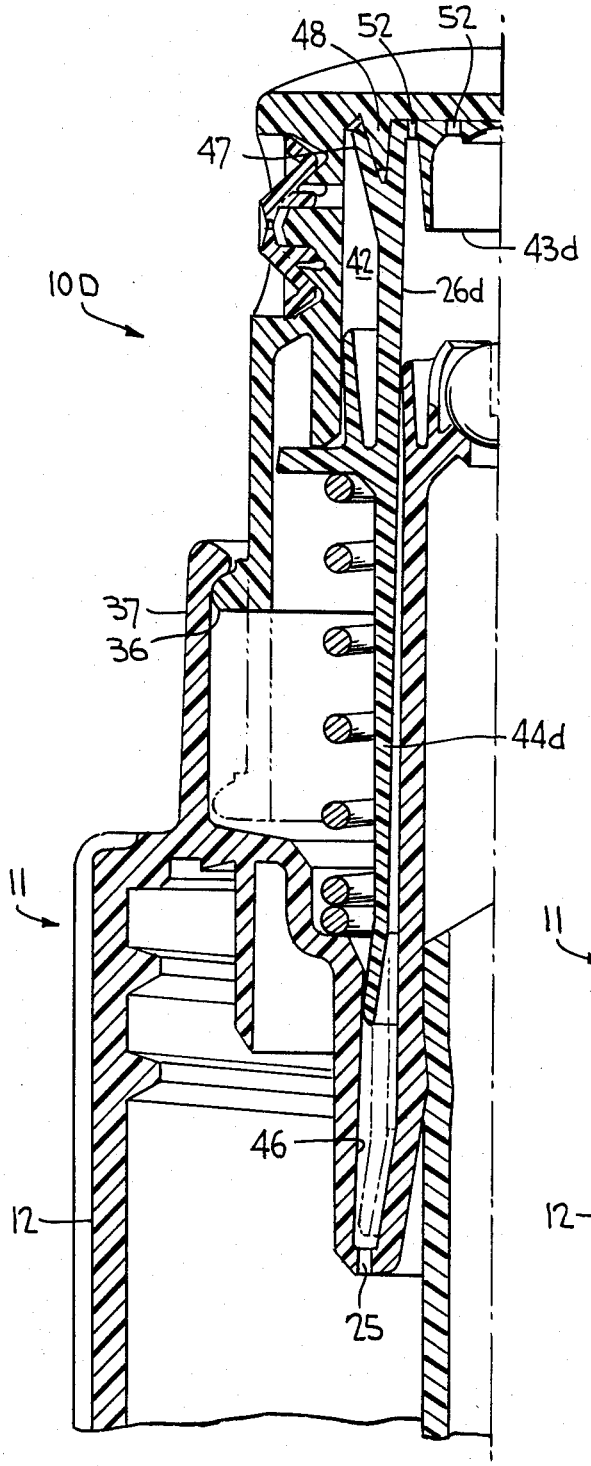
Figure 6:
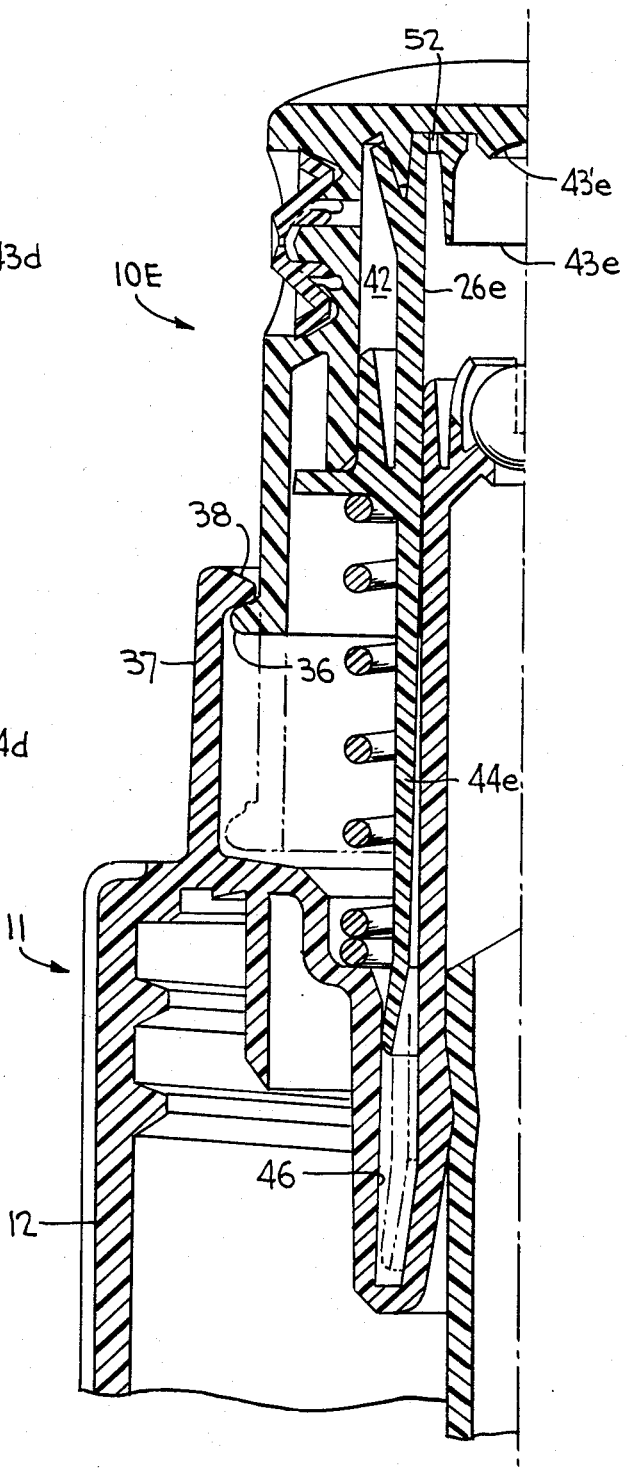

The upper end of the plunger or accumulator 26 may be similarly designed as in the FIGS. 5 and 6 pumps of my parent application Ser. No. 121,223. Thus, an outwardly extending flange 47 at the upper end of the plunger is seated on the outer surface of a ring 48, depending from the upper end of the plunger head, in the fully raised and discharge valve closing position of the plunger of FIG. 1. The lower end of the plunger is reversely bent to define a lip seal 49 in sealing engagement with the inner surface of the head bore which may also incorporate vent skirt 44, and delimiting discharge chamber 42. With such an arrangement, the terminal end of lip seal 49 lies below discharge passage 39 so that only a slight relative shifting between the plunger and the head opens the discharge as flange 47 is moved away from ring 48. A quick opening discharge is therefore made possible.

The structure of the present pump assembly as aforedescribed is such that the plunger head axis is coaxial with the axis of the pump body, and is maintained substantially coaxial with the pump body, including the collar, vent chamber and stationary piston positions, throughout plunger head reciprocations. The same venting performance is achieved as described in my parent application since vent skirt 44 functions within the vent chamber together with and in response to reciprocation of the plunger head. However, in addition to the venting function, vent skirt 44 serves also as an aligning element together with retention bead 36 which respectively glide along inner surface 46 and the inner surface of collar 37. Thus, the plunger head is permitted to reciprocate axially between stop limits while being maintained with its axis congruent with the pump body axis including especially collar 37, the vent passage, and the stationary piston portions. With this lateral axial control, the plunger head can experience various non-axial forces without cocking its axis, or otherwise losing axial congruency. Therefore, the mis-application of lateral or eccentric forces to the plunger head during reciprocation is prevented from transmitting any bias or restraining force to the plunger. Thus, the plunger, which functions as the discharge valve and pressure regulating element, is free floating between the spring force below and the hydraulic force above and is not restrained against movement in response to these forces.

An example of the effect of lateral or eccentric forces on the plunger head is the action wherein the lateral or eccentric forces thereon induce a frictional load between the plunger and its valving elements which can permit the plunger to be momentarily held open at the end of the plunger downstroke with a small quantity of product remaining within the discharge path. When the actuating force on the head is relieved, even slightly, the frictional holding force or brake is relaxed. This then causes the spring to shift the plunger immediately to its closed position. Thus, the small amount of product which had been left in the discharge path at the end of the plunger discharge stroke is now suddenly purged at the start of the plunger intake stroke as the plunger closes in response to spring pressure. This unexpected discharge at the start of the recharge stroke is at least inconvenient and should be avoided. In accordance with the invention, since the plunger cannot be partially or wholly restrained by frictional engagement due to opposing force couples or lateral pressure, it will respond continuously and promptly in the intended operating mode in balance between the hydraulic pressure and opposing spring force.

Figure 2:
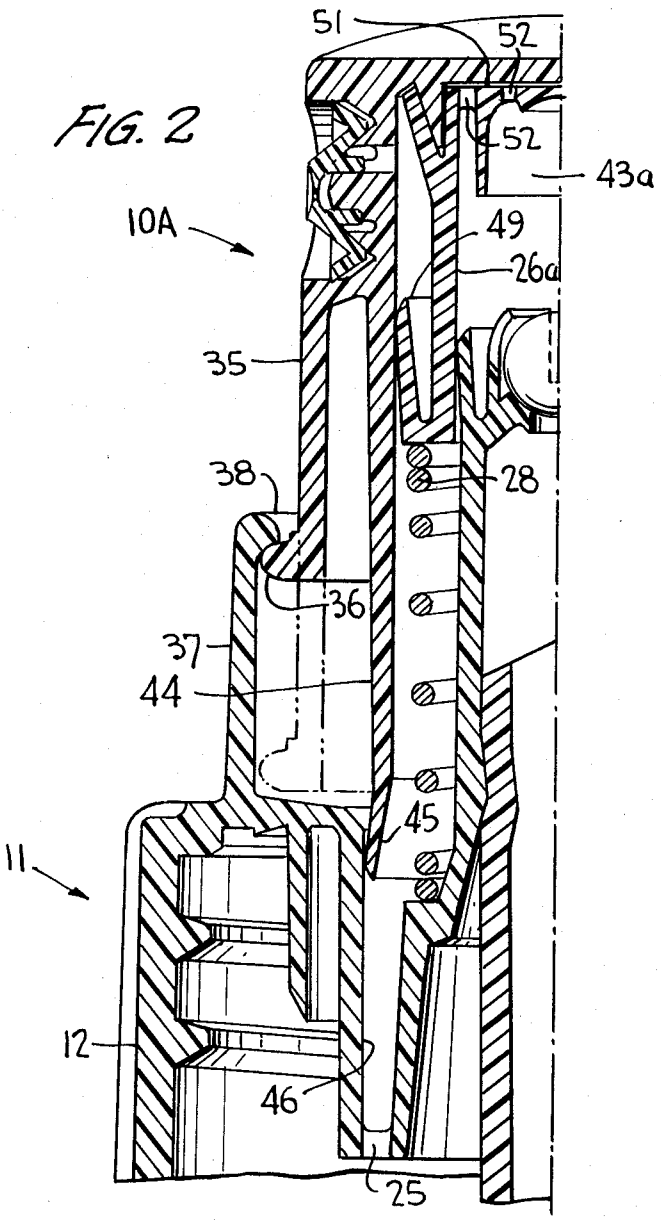
FIGS. 2 to 6 are half-section views similar to FIG. 1 of further embodiments according to the invention.

Pump assembly 10A, shown in FIG. 2, is the same in most respects to that of pump assembly 10 so that like elements will be represented by the same reference numerals. However, in this embodiment, plunger/accumulator **26*a* is structured so that, in addition to its free floating characteristic allowing it to reseat itself under the plunger head at the end of the plunger downstroke and before the ensuing plunger recharge stroke to avoid a discharge spurt after recharge commences, product is assured of being purged from the accumulation chamber before commencement of the recharge stroke. To this end, an air displacement interfacing contoured surface 43*a*, identical to surface 43 of FIG. 1, is disposed at the upper end of the plunger as an integral part thereof. This surface includes a cover wall slightly spaced as at 51 from the underside of the plunger head and including at least one through port 52 for maintaining the open communication between the pump chamber and the accumulation chamber. Thus, upon depression of the plunger head, contoured surface 43*a*** bottoms against the stationary piston and ball check valve before the plunger head reaches the end of its discharge stroke. The hydraulic pressure in the accumulation chamber upon plunger head depression maintains the head slightly spaced from the plunger during downstroke of the head so that, as this downstroke continues, the head is urged downwardly against the hydraulic pressure by the continuing finger force expelling the product above the plunger as part of the normal discharge stroke. Thus, "after spray" is avoided by mechanically assisting the plunger closing action at the end of the discharge stroke to thereby avoid any dribbling or dripping of product through the discharge at the end of the discharge stroke.

On the other hand, with contoured surface 43 carried on the underside of the plunger head as in FIG. 1, this interfacing contour of the head projects into the open upper end of the plunger so that the head interior bottoms against the upper end of the stationary piston and ball check members at the end of the discharge stroke. Thus, it is possible to exercise the discharge stroke at a velocity producing a pumping rate in excess of the orifice 41 discharge capacity at the control design pressure. The interfacing contour may thus reach the bottom of the discharge stroke while the plunger is still in a discharge valve open mode, displaced from the seat in the head, and continuing the discharge at rated pressure, expelling the accumulated product as the spring force returns the accumulator to its seated, valve closed position against the interior of the head. This continued discharge as the valve closes is referred to above as "after spray".

In the FIG. 2 embodiment, the plunger member without vent skirt and with the interfering air displacement integral contour, becomes a free floating member responding to the opposing hydraulic and spring forces plus normal frictional factors. The plunger head carries annular vent skirt 44 having a vent seal 45 which engages inner surface 46 of the vent chamber as a vent valving member, and which also serves as an alignment guide cooperating with head retention bead 36 as bearing members spaced apart axially to resist lateral or eccentric forces on the plunger head, and to isolate such forces from the plunger/accumulator. Thus, each member of the pump assembly which slides relative to its facing member is held with its axis congruent with all other cooperating members, to thereby eliminate detrimental counter-productive couples which may mitigate the performance of the assembly to an objectionable extent.

Figure 3:
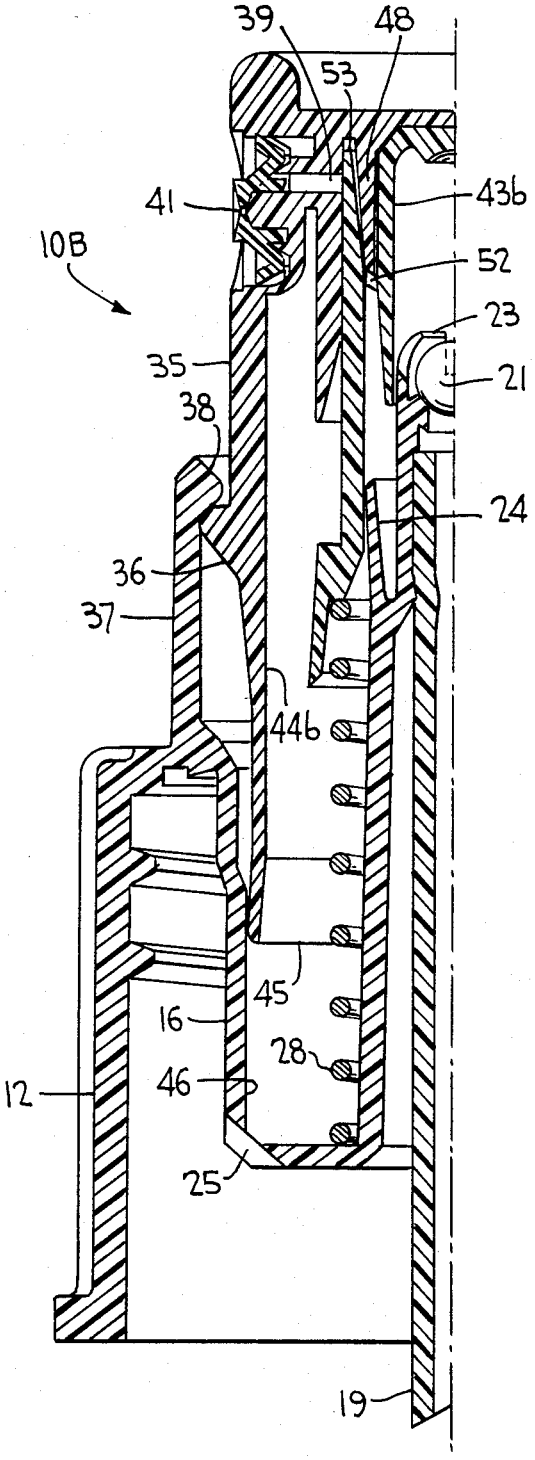

Pump assembly 10B of FIG. 3 is similar to that of assembly 10A of FIG. 2 in that contoured surface **43*b*, having at least one through port 52 therein, is disposed at the upper end of plunger 26*b* as an integral part thereof. This plunger has an annular discharge flange 53 with an upper end lying slightly above discharge passage 39 for opening same more slowly during relative reciprocation between the plunger and the piston, similarly as in FIG. 1 of my aforementioned parent application. Otherwise, plunger 26*b*, with its interfacing contoured surface 43*b*, functions the same and achieves the same results as plunger 26*a* and its contoured surface described with reference to FIG. 2**.

And, the FIG. 3 plunger head includes a vent skirt **44*b* which forms an extension of plunger skirt 35 so as to together define a single skirt which carries retention bead 36 and vent seal 45 which respectively glide along the inner surface of collar 37 and along inner surface 46. Bead 36 and vent seal 45 also serve as spaced bearing members to resist lateral or eccentric forces on the plunger head, as described in detail with reference to FIGS. 1 and 2**.

Figure 4:
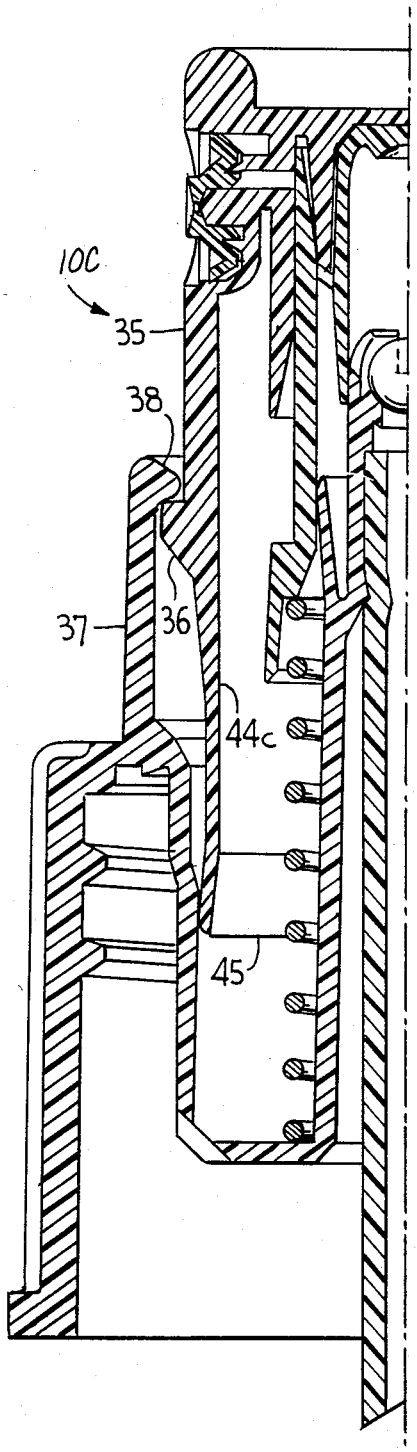

As a further variant, pump assembly 10C of FIG. 4 is the same as assembly 10B of FIG. 3 except that retention bead 38, rather than bead 36, functions as a bearing member as it is guided along the outer surface of skirt 35 during plunger reciprocation. With such an arrangement, it can be seen that, upon inward movement of the plunger, the bearing separation between 38 and 45 is increased thereby enhancing plunger head stability.

Pump assembly 10D of FIG. 5 is essentially the same as that disclosed in the aforementioned parent application in that vent skirt **44*d* extends from plunger 26*d* for performing the venting function as therein described. However, contoured surface 43*d*, identical to surface 43*a* of FIG. 2, is disposed at the upper end of plunger 26*d* as an integral part thereof and functions in the identical manner as that described with reference to FIG. 2**.

Pump assembly 10E of FIG. 6 is essentially the same as assembly 10D except that retention bead 38 glides along the outer surface of skirt 35 to thereby function in the same manner as that described with reference to FIG. 4. And, a contoured surface **43*e* is disposed at the upper end of plunger 26*e* as an integral part thereof and functions in the same manner as that described with reference to FIG. 2 except that a central contoured portion 43*e***, which matches the ball check valve, is located on the underside of the plunger head.

It should be pointed out that despite the outward flaring from top to bottom of inner surface 46 of the vent passage, the vent skirt on the plunger of the FIGS. 1 and 2 embodiments is nevertheless guided by this surface for the purposes described since the taper is so minute so to not affect this function. Also, in lieu of a flared surface 46 in the vent chamber, an elongated vent opening may be provided, or surface 46 may have an enlarged diameter between opposite ends, or an elongated vertical rib together with a vent opening would suffice for controlling the opening and closing of the vent passage as the vent seal is guided along wall 16.

From the foregoing, it can be seen that an optional structural arrangement is available for my pressure accumulating-type dispensing pumps which function to avoid any dribbling and dripping of product from the discharge at the end of the plunger discharge stroke, by the adoption of simple yet highly effective measures. The plunger/accumulator is developed as free floating and/or having at its upper end an air displacement interfacing contour for assuring continuous and quick response in the intended operating mode and for mechanically effecting a discharge valve closing assist at the end of the plunger discharge stroke.

Terms of orientation, such as "upstanding", "upper", "lower", "upward" and depending", are used to lend clarity to identify the orientation relative to the drawings. These terms are therefore not intended to limit the scope of the invention or to exclude any equivalent structure.

Obviously, many other modifications and variations of the present invention are made possible in the light of the above teachings. It is therefore to be understood that within the scope of the appended claims the invention may be practiced otherwise than as specifically described.

What is claimed is:

1. A dispensing pump comprising, a pump body adapted for fluid tight communication with the opening of a container of flowable product to be dispensed, said pump body including a stationary upstanding piston, a container vent opening, and a collar surrounding said piston, an annular plunger mounted for reciprocation on said piston to define therewith a variable volume pump chamber, said piston having a valve controlled inlet passage, a plunger head slidably disposed on said plunger for reciprocation and having means defining a variable volume accumulation chamber in open communication with said pump chamber, means resiliently urging said plunger into a fully raised position above said pump body, said head having a discharge passage adapted to be opened and closed by said plunger upon movement in response to a change in pressure within said pump chamber, retention beads on said plunger head and on said collar for limiting said plunger head in a predetermined raised position wherein said plunger closes said discharge passage in said fully raised position thereof, said retention beads extending laterally respectively toward confronting surfaces of said collar and said plunger head, one of said beads defining a first annular bearing member in sliding engagement with one of said confronting surfaces during plunger head reciprocation, said pump body further including a vertical annular wall spaced from said piston and therewith defining a vent chamber which includes said vent opening, a vent skirt extending from said plunger head and having an annular vent seal defining a second bearing member slidably guided along said wall during said plunger head reciprocation, said vent chamber being adapted to be closed by said vent seal in said fully raised position of said plunger and to be opened by said vent seal during plunger reciprocation, and said bearing members being spaced apart acting to resist any lateral or eccentric forces applied to said head during its reciprocation to thereby isolate said forces from said plunger permitting it to respond without restraint during said movement in opening and closing said discharge passage.

2. The dispensing pump according to claim 1, wherein a plunger skirt extends from said head concentric with said vent skirt, said first and second bearing members being respectively located on said skirts.

3. The dispensing pump according to claim 1, wherein a plunger skirt extends from said head concentric with said vent skirt, said first and second bearing members being respectively located on said collar and said vent skirt.

4. The dispensing pump according to claim 1, wherein said plunger head includes a plunger skirt with said vent skirt extending therefrom, said first and second bearing members being respectively located on said skirts.

5. The dispensing pump according to claim 1, wherein said plunger head includes a plunger skirt with said vent skirt extending therefrom, said first and second bearing members being respectively located on said collar and said vent skirt.

6. The dispensing pump according to claim 1, wherein the upper end of said plunger has wall means thereon complementarily contoured to and facing the upper end of said piston, said wall means having at least one port therein for maintaining the open communication between said chamber, whereby said pump chamber may be effectively primed upon depressing said head, and whereby after pump priming, said contoured wall means bears against said upper end of said piston at the end of the plunger downstroke while said discharge passage remains open allowing for further depression of said head, so that said plunger head will continue to expel product through said discharge passage upon said further depression before said plunger moves into its discharge closing position.

7. A dispensing pump, comprising a pump body sealingly mounted on a container of flowable product to be dispensed, said body having a container vent opening therein and a stationary upstanding piston thereon, an annular plunger resiliently urged into a fully raised position and mounted for reciprocation on said piston to define therewith a variable volume pump chamber, a valve controlled inlet passage in said piston, a plunger head slidably disposed on said plunger for reciprocation and having means defining a variable volume accumulation chamber in open communication with said pump chamber, said head also having a discharge passage adapted to be opened and closed by said plunger upon movement in response to a change in pressure within said pump chamber, said pump body further including a vent chamber which includes said vent opening, and a vent skirt on said plunger adapted for closing said vent chamber in the raised position of said plunger and for opening said vent chamber during an initial and further downstroke position of said plunger, perforate wall means at an upper end of said plunger confronting the upper end of said piston and being complementarily contoured thereto, whereby said pump chamber may be effectively primed upon depressing said head, and whereby, after pump priming, said wall means bears against said upper end of said piston at the end of the plunger downstroke while said discharge passage remains open allowing for further depression of said head, so that said plunger head will continue to expel product through said discharge passage upon said further depression before said plunger moves into its discharge closing position.

8. The dispensing pump according to claim 6, wherein said wall means comprises a cover wall slightly spaced from the undersurface of said head in said discharge closing position of said plunger.

9. The dispensing pump according to claim 7, wherein said wall means comprises a cover wall slightly spaced from the undersurface of said head in said discharge closing position of said plunger, said cover wall having ports therein for maintaining the open communication between said chamber.

10. A dispensing pump of the pressure accumulating type comprising, a pump body adapted to be secured in a fluid tight manner over the opening of a container of product to be dispensed, said pump body having a container vent opening therein and a stationary upstanding piston thereon, an annular plunger resiliently urged into a fully raised position above said body and being mounted for reciprocation on said piston to define therewith a variable volume pump chamber, a valve controlled inlet passage in said piston, a plunger head having a downwardly directed blind socket slidably disposed on said plunger and therewith defining a variable volume accumulation chamber between said plunger and the blind end of said socket, and being in open communication with said pump chamber, said plunger head having a discharge passage adapted to be opened and closed by relative movement between said plunger and said plunger head, means for limiting the upward movement of said plunger head at a predetermined position in which said plunger is urged at said fully raised position thereof into said socket to function as a valve for closing said passage, wall means at the upper end of said plunger defining a contoured surface facing the upper end of said piston, said wall means having at least one port therein for maintaining the open communication between said chambers, said upper end of said piston being complementarily contoured, whereby said pump chamber may be effectively primed upon depressing said head, and whereby, after pump priming, said contoured surface bears against said upper end of said piston at the end of the plunger downstroke while said discharge passage remains open thereby allowing for further depression of said head which continues to expel product through said discharge passage from said accumulation chamber before said plunger is urged into said socket for closing said passage.

11. The dispensing pump according to claim 10, wherein said wall means defining said contoured surface comprises a cover wall spaced a slight distance from the undersurface of said plunger head in said predetermined position of said plunger.

12. A dispensing pump of the pressure accumulating type comprising, a pump body adapted to be sealingly mounted on a container of flowable product to be dispensed, said body having a container vent opening therein and a stationary upstanding piston thereon, an annular plunger resiliently urged into a fully raised position above said pump body and being mounted for reciprocation on said piston to define therewith a variable volume pump chamber, a valve controlled inlet passage in said piston, a plunger head having a downwardly directed blind socket slidably disposed on said plunger and therewith defining a variable volume accumulation chamber between said plunger and the blind end of said socket, and being in open communication with said pump chamber, said plunger head having a discharge passage adapted to be opened and closed by relative movement between said plunger and said plunger head, a collar on said pump body for guiding said plunger head during reciprocation, means on said plunger head and said collar for limiting the upward movement of said plunger head at a predetermined position in which said plunger is urged at said fully raised position thereof into said socket to function as a valve for closing said passage, means on said pump body defining a container vent chamber for establishing communication between the outside of said pump body and the interior of the container via said vent opening, said means comprising an annular wall spaced from and surrounding said piston, a vent skirt extending from said plunger head and having an annular vent seal in engagement with an inner surface of said annular wall for further guiding said plunger head during reciprocation and for closing said vent chamber while said plunger is in said fully raised position and during an initial downstroke reciprocation thereof, said vent skirt adapted to open said vent chamber upon a further downstroke reciprocation of said plunger, said annular wall and one of said collar and said plunger head serving to guide said plunger head along an axis concentric with the central axis of said pump body during plunger head reciprocation for thereby isolating said plunger against any lateral or eccentric outside forces acting on said plunger head whereby said plunger floats freely during its reciprocation without hindrance from said outside forces.

13. The dispensing pump according to claim 12, wherein said limiting means are axially spaced from said vent seal.

14. The dispensing pump according to claim 12, wherein the upper end of said plunger terminates in wall means defining a contoured surface facing the upper end of said piston, said wall means having ports therein maintaining the open communication between said pump and accumulation chambers, the upper end of said piston being complementarily contoured, whereby said pump chamber may be effectively primed upon depressing said head, and whereby, after pump priming, said contoured surface abuts against said upper end of said piston at the end of the plunger downstroke while said discharge passage remains open thereby allowing for further depression of said head which continues to expel product through said discharge passage before said plunger is urged into said socket for closing said passage.

15. The dispensing pump according to claim 14, wherein said wall means defining said contoured surface comprises a cover wall having a outer surface spaced slightly way from the undersurface of said plunger head in said predetermined position of said plunger.

* * * * *